US007050013B2

(12) United States Patent
Kim et al.

(10) Patent No.: US 7,050,013 B2
(45) Date of Patent: May 23, 2006

(54) ULTRA-WIDEBAND PLANAR ANTENNA HAVING FREQUENCY NOTCH FUNCTION

(75) Inventors: Yong-Jin Kim, Seoul (KR); Do-Hoon Kwon, Seoul (KR); Seong-Soo Lee, Suwong-si (KR)

(73) Assignee: Samsung Electronics Co., Ltd., (KR)

( * ) Notice: Subject to any disclaimer, the term of this patent is extended or adjusted under 35 U.S.C. 154(b) by 0 days.

(21) Appl. No.: 11/023,723

(22) Filed: Dec. 28, 2004

(65) Prior Publication Data

US 2006/0055612 A1 Mar. 16, 2006

(30) Foreign Application Priority Data

Dec. 31, 2003 (KR) ..... 10-2003-0101708

(51) Int. Cl.
*H01Q 13/10* (2006.01)

(52) U.S. Cl. ..... 343/770; 343/767; 343/725

(58) Field of Classification Search ..... 343/767, 343/770

See application file for complete search history.

(56) References Cited

U.S. PATENT DOCUMENTS 3,373,432 A * 3/1968 Breneman ..... 343/808
5,404,146 A * 4/1995 Rutledge ..... 343/720
5,828,340 A 10/1998 Johnson ..... 343/700 MS
6,091,374 A 7/2000 Barnes ..... 343/787
6,424,309 B1 * 7/2002 Johnston et al. ..... 343/767
6,429,819 B1 * 8/2002 Bishop et al. ..... 343/725
6,621,462 B1 * 9/2003 Barnes ..... 343/787
6,762,730 B1 * 7/2004 Schadler ..... 343/770

FOREIGN PATENT DOCUMENTS

WO WO 02/093690 11/2002

* cited by examiner

*Primary Examiner*—Tho Phan
(74) *Attorney, Agent, or Firm*—Dilworth & Barrese LLP

(57) ABSTRACT

A planar antenna manufactured by patterning a substrate consisting of a dielectric layer, and first and second conductive layers applied, respectively, to both opposite surfaces of the dielectric layer. A first slot is formed in the first conductive layer for radiating electric waves. A second slot is formed in the first conductive layer for intercepting a particular frequency of the electric waves radiated by the first slot. A power supply portion is formed with the first conductive layer for supplying electric current to the first slot. A radiating element formed with the second conductive layer, which is excited by the electric waves radiated by the first slot, and radiates the electric waves.

25 Claims, 7 Drawing Sheets

ULTRA-WIDEBAND PLANAR ANTENNA HAVING FREQUENCY NOTCH FUNCTION

PRIORITY

This application claims priority to an application entitled "ULTRA-WIDEBAND PLANAR ANTENNA HAVING FREQUENCY NOTCH FUNCTION", filed in the Korean Intellectual Property Office on Dec. 31, 2003 and assigned Serial No. 2003-101708, the contents of which are hereby incorporated by reference.

BACKGROUND OF THE INVENTION

1. Field of the Invention

The present invention relates generally to a wireless communication system, and more particularly to a planar antenna for use in an ultra-wideband wireless communication system having a frequency notch function.

2. Description of the Related Art

Currently, wideband communication systems using electric pulses have been mainly used in military applications, and even when used in non-military applications their use has been limited to detecting mines buried under the ground or searching for survivors buried under collapsed buildings. However, according to an approval given in 2002 by the Federal Communications Commission (FCC), a frequency band of 3.1 GHz to 10.6 GHz is available for industrial use in the fields of radar, position tracking, and data transmission. Therefore, ultra-wideband (UWB) systems operating in the frequency band of 3.1 GHz to 10.6 GHz are in development.

One of the most important essential components of the UWB systems is the antenna. Because the UWB systems communicate using pulses, they require specific antennas, which operate independent of frequency, and have input impedance characteristics satisfying a required wideband. Further, when such antennas are used with mobile communication equipment, due to the nature of such portable equipment, they need to be much smaller and lighter, and are preferably planar antennas, which are constructed using printed circuit board methods. Because the planar antennas can be mass-produced by using the printed circuit board methods, they are very suitable for the manufacture of communication equipment from an economic point of view.

UWB systems should not exert any effects upon existing communication systems, or disturb communication between the existing systems. In order to restrict interference with electromagnetic waves generated by existing systems, there is a need for ultra-wideband (UWB) antennas having a frequency notch function.

The kinds of antennas known to date can be basically classified into resonant antennas, and traveling wave antennas. Among the traveling wave antennas, especially, in consideration of the fact that the UWB systems require antennas that operate independent of frequency due to the nature thereof, there is a transverse electromagnetic (TEM) horn antenna, a biconical antenna, a bowtie antenna, a tapered slot antenna, etc. The TEM horn antenna and biconical antenna, however, are unsuitable for use in small wireless communication ultra-wideband systems since they are relatively large, and have a three-dimensional design. The bowtie antenna and tapered slot antenna, which are both small in size, have difficulty satisfying impedance characteristics throughout a required wideband of the wireless communication ultra-wideband systems. Therefore, novel two-dimensional small planar antennas have been recently developed.

As examples of ultra-wideband, planar antennas proposed to date, there is an antenna having two elliptical radiators (as disclosed in International Patent Application No. WO 02093690 A1), an antenna having an inverted triangular radiator structure (as disclosed in U.S. Pat. No. 5,828,340), and an antenna having leaf-shaped slot radiators (as disclosed in U.S. Pat. No. 6,091,374). These small planar antennas emphasize thorough coverage of a required wide frequency band, but do not have a frequency notch function required of UWB antennas.

A frequency band assigned to the UWB systems is in the range of 3.1 GHz to 10.6 GHz. Within this frequency band, the UWB systems require a frequency band gap between 5.15 GHz and 5.35 GHz, which is assigned to a present wireless local area network (WLAN), in order to prevent interference with electromagnetic waves generated by existing WLAN systems. Therefore, there remains a need to develop UWB antennas having a frequency notch function.

SUMMARY OF THE INVENTION

Therefore, the present invention has been designed in view of the above and other problems, and it is an object of the present invention to provide an ultra-wideband, planar antenna, which comprises a "V"-shaped slot, thereby being capable of providing a frequency notch function.

It is another object of the present invention to provide an ultra-wideband, planar antenna, which is configured in such a fashion that a slot for providing a frequency notch function, that is adjustable in length and width thereof, thereby being capable of varying a frequency notch band.

It is yet another object of the present invention to provide an ultra-wideband, planar antenna, which has a frequency notch function for preventing interference with electromagnetic waves of existing communication systems.

It is still another object of the present invention to provide an ultra-wideband, planar antenna, which realizes a frequency notch function in a small planar antenna, thereby achieving compact portable communication equipment for ultra-wideband communication systems.

It is further another object of the present invention to provide an ultra-wideband, planar antenna, which is mass-produced using a printed circuit board method, thereby reducing manufacturing costs of communication equipment.

In accordance with an aspect of the present invention, the above and other objects are accomplished by a planar antenna comprising: a square dielectric substrate; a first conductive layer stacked at one surface of the dielectric substrate, under the assumption that an axis penetrating through a center point of the dielectric substrate is a z-axis, and two axes extending parallel to the dielectric substrate so as to cross each other at a right angle are an x-axis and y-axis, respectively, the first conductive layer having a first slot in the form of an elongated bowtie extending along the x-axis about the z-axis, a "V"-shaped second slot extending adjacent to the first slot, and a power supply portion connected to one side wall of the first slot; and a second conductive layer stacked at an opposite surface of the dielectric substrate and including a bowtie shaped radiating element coaxial relative to the first slot.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION OF THE PREFERRED EMBODIMENTS

An ultra-wideband antenna in accordance with preferred embodiments of the present invention will be described in detail herein below with reference to the annexed drawings. In the following description, a detailed description of known functions and configurations incorporated herein will be omitted when it may make the subject matter of the present invention rather unclear. Also, the terms used in the following description are terms defined by considering the functions obtained in accordance with the present invention.

In accordance with preferred embodiments of the present invention, an ultra-wideband antenna is configured in such a fashion that an antenna radiator is made of a thin metal plate 3 cm in length and 3 cm in width. The material of the antenna radiator is removed to form a bowtie shaped slot. The metal plate is stacked on one surface of a dielectric substrate.

In addition, in order to improve the impedance characteristics of the antenna in a required wideband, another bowtie antenna element is provided on the other surface of the dielectric substrate at a position corresponding to the slot. In order to realize a frequency notch function, a "V"-shaped slot is formed at an upper end of the metal plate.

Figure 1:
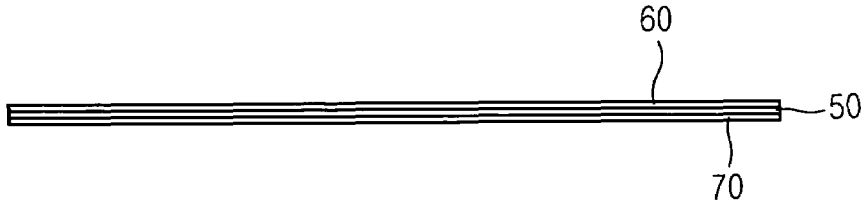
FIG. 1 is a side view illustrating a stacked structure of a substrate embodying an ultra-wideband antenna in accordance with the present invention.

FIG. 1 is a side view illustrating a stacked structure of the substrate embodying the ultra-wideband antenna in accordance with the present invention. The ultra-wideband antenna comprises a square dielectric substrate 50, a first metallic radiation layer 60 bonded to one surface of the dielectric substrate 50, and a second metallic radiation layer 70 bonded to the other surface of the dielectric substrate 50. The first and second metallic radiation layers 60 and 70 have the same area as that of the dielectric substrate 50.

Figure 2A:
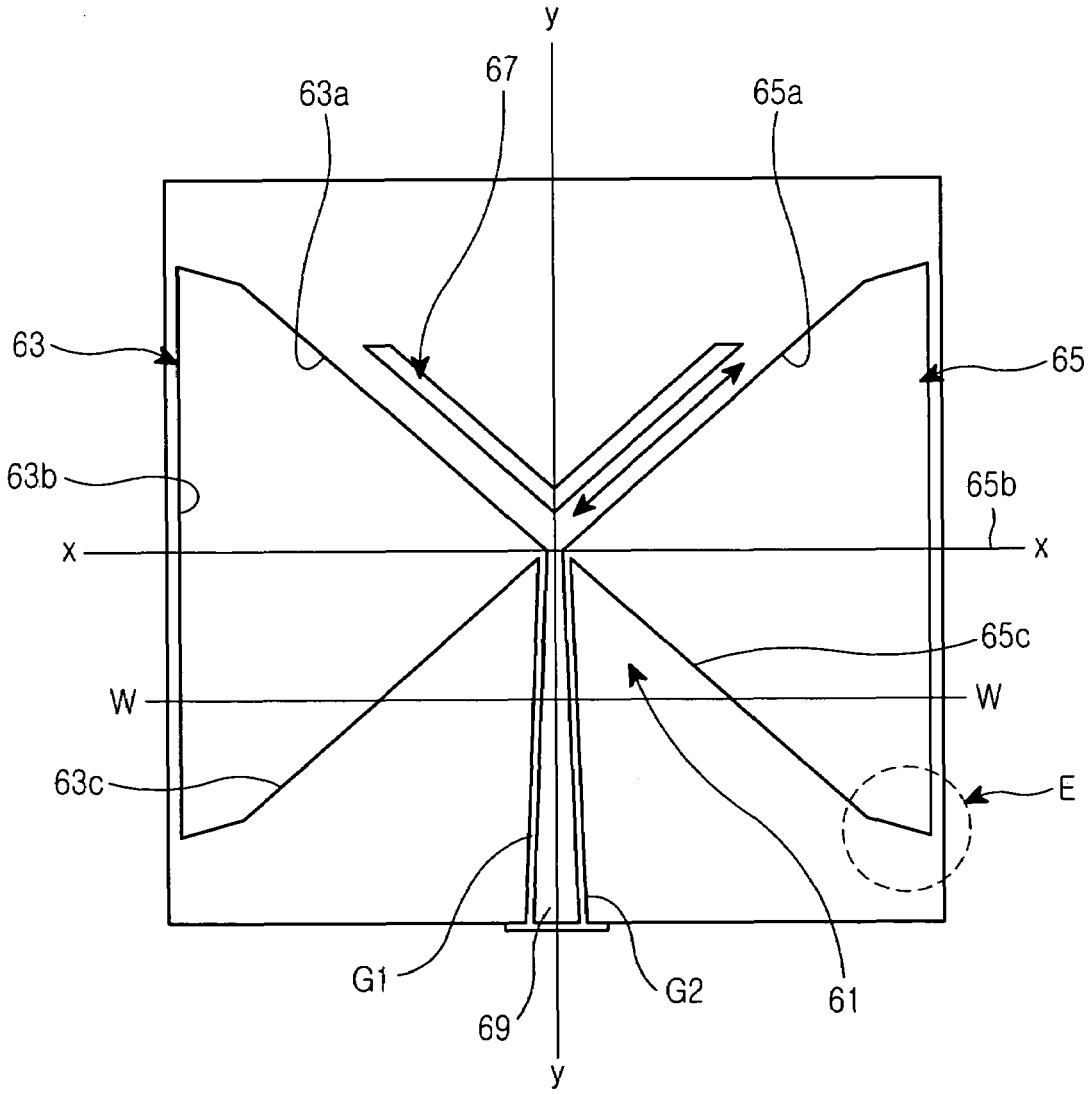
FIG. 2*a* is a plan view illustrating a front surface of a planar slot antenna in accordance with a first preferred embodiment of the present invention.
Figure 2B:
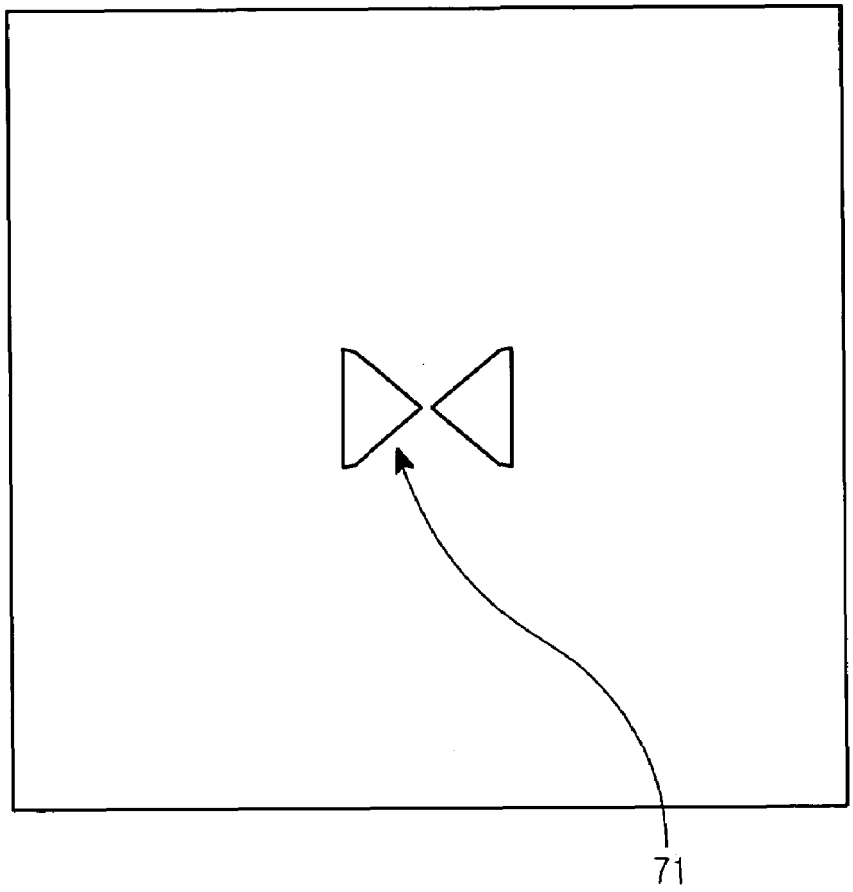
FIG. 2*b* is a plan view illustrating a rear surface of the planar slot antenna in accordance with the first preferred embodiment of the present invention.
Figure 2C:
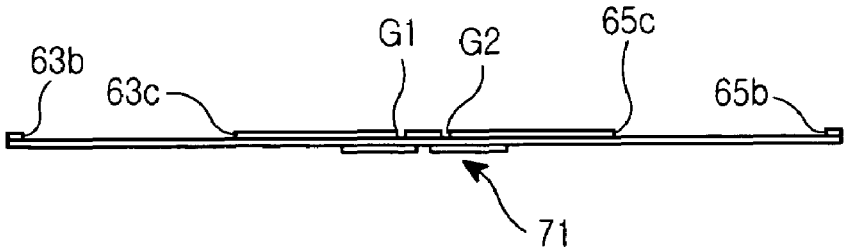
FIG. 2*c* is a lateral sectional view taken along the line w—w shown in FIG. 2*a* illustrating the planar slot antenna in accordance with the first preferred embodiment of the present invention.

FIGS. 2*a* and 2*b* are plan views illustrating a front surface and rear surface, respectively, of a planar slot antenna in accordance with a first preferred embodiment of the present invention. FIG. 2*c* is a lateral sectional view taken along the line w—w shown in FIG. 2*a*, illustrating the planar slot antenna in accordance with the first preferred embodiment of the present invention.

As illustrated in FIG. 2*a*, a first slot radiating element 61, which includes two triangular slot portions 63 and 65 defining a bowtie shape positioned with their apexes facing each other, is cut out in the first metallic radiation layer 60. Through the first slot radiating element 61, the dielectric substrate 50 is exposed to the outside. One of the triangular slot portions, namely, the first triangular slot portion 63, is delimited by a first inner wall 63*a*, a second inner wall 63*c*, and a third inner wall 63*b*. The other triangular slot portion, namely, the second triangular slot portion 65, is delimited by a first inner wall 65*a*, a second inner wall 65*c*, and a third inner wall 65*b*.

In order to achieve desired wideband impedance characteristics, at four outer corners (E) of the first and second triangular slot portions 63 and 65, respectively, where the first and third inner walls 63*a* and 63*b* of the first triangular slot portion 63 meet, where the second and third inner walls 63*c* and 63*b* of the first triangular slot portion 63 meet, where the first and third inner walls 65*a* and 65*b* of the second triangular slot portion 65 meet, and where the second and third inner walls 65*c* and 65*b* of the second triangular slot portion 65 meet, the first and second inner walls 63*a* and 63*c* of the first triangular slot portion 63 and the first and second inner walls 65*a* and 65*c* of the second triangular slot portion 65 are bent to form a desired interior angle.

A second slot radiating element 67 is cut in the first metallic radiation layer 60*t*. The second slot radiating element 67 has a "V"-shape, wherein two sides thereof symmetrically extend, on the basis of the Y-axis, along the first inner wall 63*a* of the first triangular slot portion 63 and the first inner wall 65*a* of the second triangular slot portion 65. Through the second slot radiating element 67, the dielectric substrate 50 is exposed to the outside.

One side of the "V"-shaped second slot radiating element 67 has a length of $\lambda_c/2$. Here, $\lambda_c$ is equal to the wavelength of the center frequency of the frequency band, which should not be interfered with.

Additionally, a power supply portion 69, which extends from the two facing apexes of the first and second triangular slot portions 63 and 65 toward the outside of the first metallic radiation layer 60, is cut in the first metallic radiation layer 60. The power supply portion 69 is outwardly tapered in order to set the input impedance to 50 ohms. The power supply portion 69 has a width of 1.5 mm at its widest region, and a width of 0.1 mm at its narrowest region. The power supply portion 69 is delimited at opposite sides thereof by both gaps G1 and G2, which are preferably formed during the cutting of the first metallic radiation layer 60. Each gap G1 or G2 is tapered so that the width thereof is reduced from 0.22 mm to 0.2 mm.

Electric current supplied through the power supply portion 69 flows along the first inner walls 63*a* and 65*a*, second inner walls 63*c* and 65*c*, and third inner walls 63*b* and 65*b* of the first and second triangular slot portions 63 and 65, which constitute the first slot radiating element 61.

As illustrated in FIG. 2*b*, the second metallic radiation layer 70 is configured so that the larger portion thereof is cut out, leaving a conductor radiating element 71 at the center of the dielectric substrate 50. The conductor radiating element 71 takes the form of a miniature version of the bowtie shaped first slot radiating element 61 formed at the first metallic radiation layer 60, and protrudes outwardly from the rear surface of the dielectric substrate 50 (See FIG. 2*c*). Preferably, the area ratio of the conductor radiating element 71 to the first slot radiating element 61 is 1 to 5.6.

The dielectric substrate 50 is preferably made of FR-4 epoxy (having a specific dielectric constant of approximately 4.4), and the power supply portion 69 has a co-planar waveguide (CPW) structure.

The ultra-wideband antenna in accordance with the first preferred embodiment of the present invention comprises three radiating elements, namely, the first slot radiating element 61, the second slot radiating element 67, and the conductor radiating element 71.

The electric current, supplied through the power supply portion 69, mainly flows along the bowtie shaped first slot radiating element 61, and creates an electric field parallel to the X-Y plane.

The second slot radiating element 67 changes current distribution of the first metallic radiation layer 60 as a conductor, thereby performing a frequency notch function. In order to be shaped and positioned so as not to disturb wideband impedance characteristics thereof, the second slot radiating element 67 has a "V"-shape extending parallel to an upper end of the bowtie shaped first slot radiating element 61. The "V"-shaped second slot radiating element 61 can change a desired notch frequency depending on a length and width thereof.

The conductor radiating element 71, which is formed at the rear surface of the dielectric substrate 50, causes radiation of electric waves, which start by the electric field of the power supply portion 69 and are induced through the dielectric substrate and conductors, thereby improving input impedance characteristics of the antenna.

The ultra-wideband antenna in accordance with the preferred embodiment of the present invention is designed to start radiation from a frequency of 3.1 GHz. The first slot radiating element 61 has a length of 2.8 cm in an X-axis direction. The first and second inner walls 63*a* and 63*c* of the first triangular slot portion 63 and the first and second inner walls 65*a* and 65*c* of the second triangular slot portion 65 are bent to form a desired interior angle as stated above. The four outer corners (E) of the first slot radiating element 61 define an interior angle of 45°. Further, each side of the "V"-shaped second slot radiating element 67 has a length of 1.1 cm and a width of 1 mm, and an interior angle thereof defined in the valley of the "V"-shaped second slot radiating element is 45°. By adjusting the length and width of the second slot radiating element, it is possible to vary a desired notch frequency.

Figure 3:
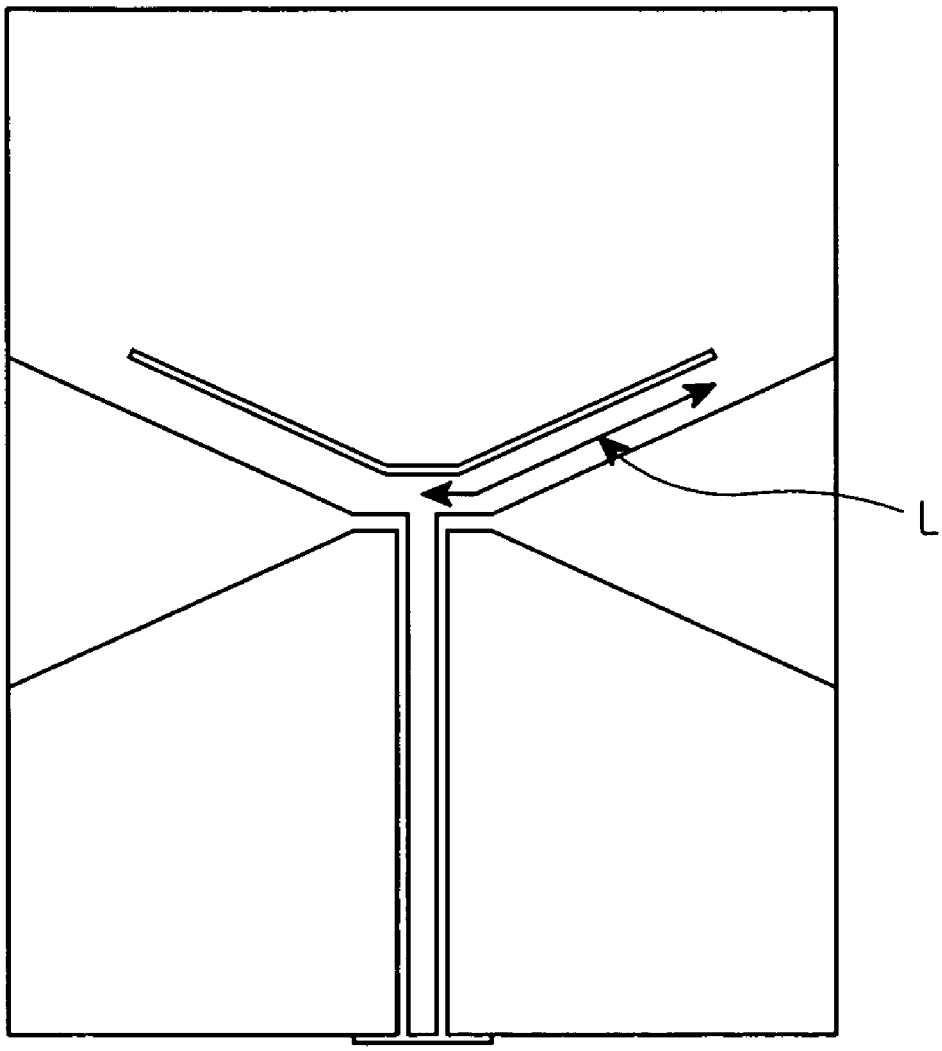
FIG. 3 is a plan view illustrating an ultra-wideband antenna in accordance with a second preferred embodiment of the present invention.

FIG. 3 is a plan view illustrating an ultra-wideband antenna obtained in accordance with a second preferred embodiment of the present invention. The ultra-wideband antenna in accordance with the second embodiment is a planar dipole antenna.

As illustrated in FIG. 3, the planar dipole antenna also has a second slot radiating element at an upper side of a first slot radiating element formed therein, and the operation and function of the planar dipole antenna is the same as that of the ultra-wideband antenna in accordance with the first embodiment. Therefore, the ultra-wideband antenna in accordance with the second embodiment also achieves a frequency notch function, and enables the variation of a notch frequency through the adjustment of a length (L) of one side of the "V"-shaped slot radiating element.

FIGS. 4 to 7 are graphs illustrating results of a performance test of the ultra-wideband antenna in accordance with the present invention. In this test, the planar slot antenna, which has the "V"-shaped slot for achieving a frequency notch function in an ultra-wideband of 3.1 GHz to 10.6 GHz, was compared with a conventional antenna having no "V"-shaped slot, in view of variations of voltage standing wave ratio (VSWR) and reflection coefficient. The antennas, to be compared in the test, were formed by coating a metallic material 0.036 mm in thickness onto a 1 mm thick FR-4 epoxy substrate.

Figure 4:
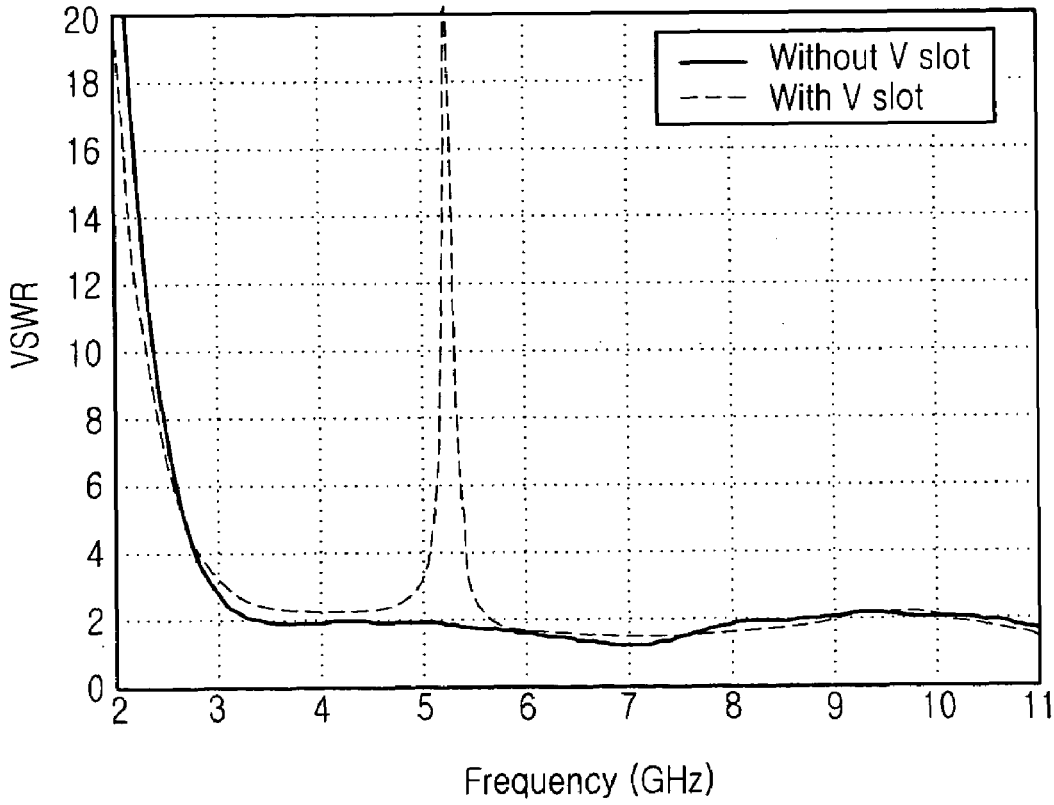
FIG. 4 is a graph illustrating results of a performance test, measuring the voltage standing wave ratio (VSWR) of the ultra-wideband antenna in accordance with the first preferred embodiment of the present invention.

FIG. 4 is a graph illustrating comparative performance results of these ultra-wideband antennas in view of voltage standing wave ratio (VSWR). As can be seen from FIG. 4, in a frequency band of 5.15 GHz through 5.35 GHz, the antenna, having no "V"-shaped slot, showed a VSWR value of 1.8, whereas the antenna, having the "V"-shaped slot, showed a VSWR value of 20. Further, it can be seen that there is no variation in input impedance characteristics of the ultra-wideband antennas in other frequency bands.

Figure 5:
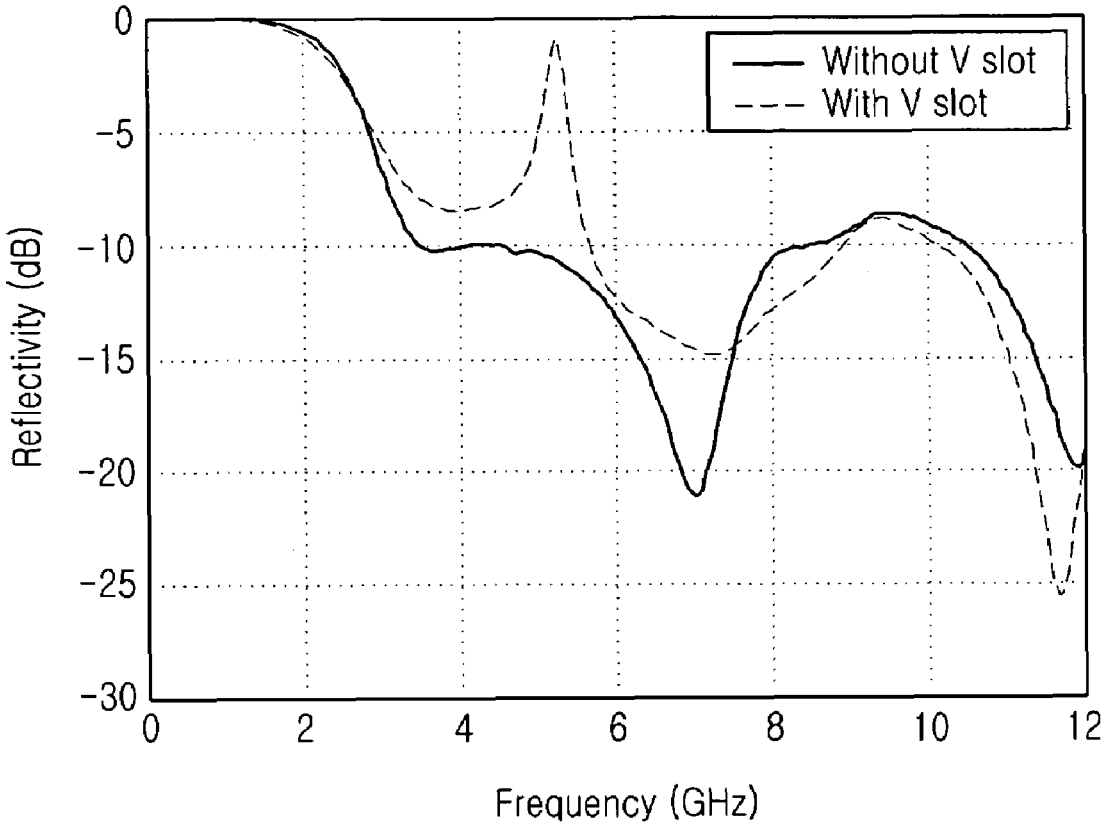
FIG. 5 is a graph illustrating results of a performance test, measuring the reflective coefficient of the ultra-wideband antenna in accordance with the first preferred embodiment of the present invention.

FIG. 5 is a graph illustrating comparative performance results of these ultra-wideband antennas in view of reflection coefficients. As can be seen from FIG. 5, in the frequency band of 5.15 GHz to 5.35 GHz, a reflection coefficient of the antenna, having the "V"-shaped slot, is higher than that of the antenna, having no "V"-shaped slot, by approximately 10 dB. Therefore, it can be clearly understood that the ultra-wideband antenna having the "V"-shaped slot provides a frequency notch function in the above particular frequency band.

Figure 6:
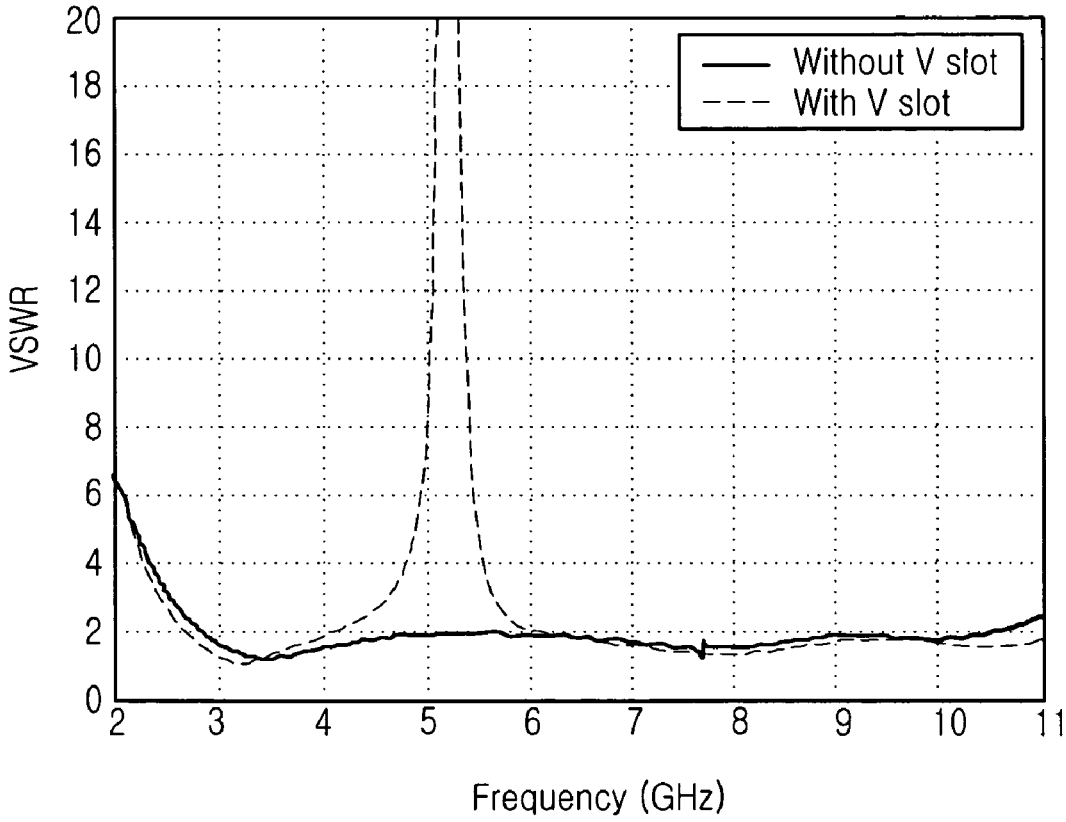
FIG. 6 is a graph illustrating results of a performance test of the ultra-wideband, planar dipole antenna in accordance with the second preferred embodiment of the present invention, by comparing respective cases with and without a "V"-shaped slot.
Figure 7:
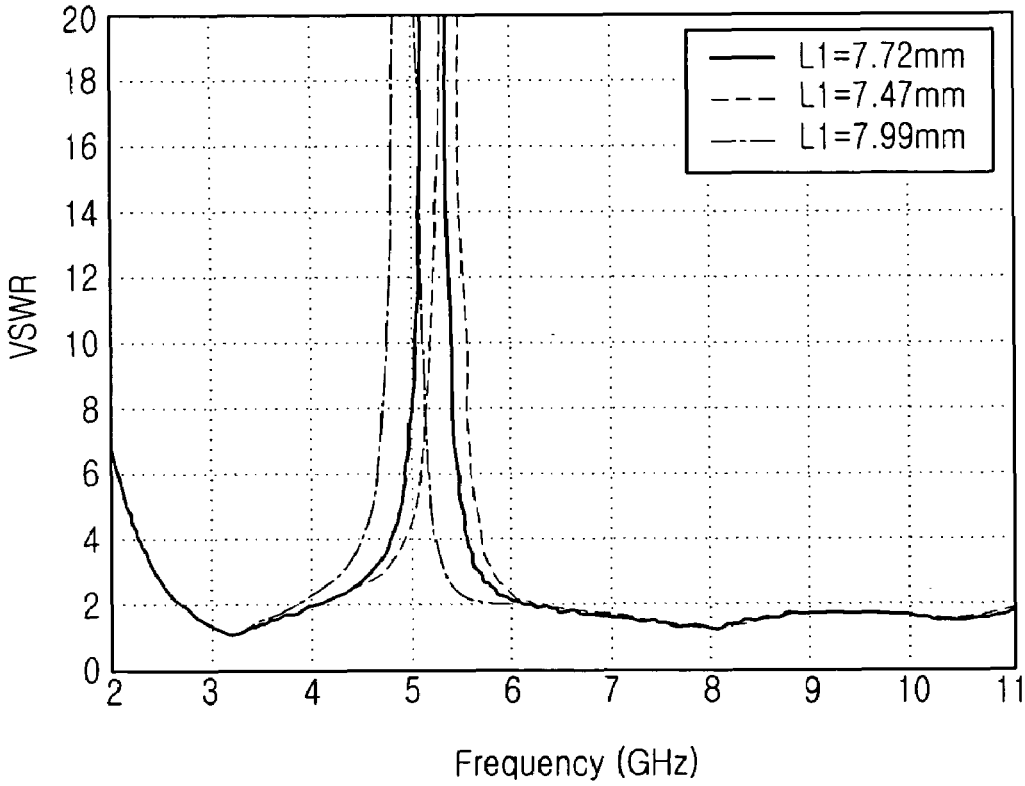
FIG. 7 is a graph illustrating the variation of the voltage standing wave ratio (VSWR) depending on the variable length of the "V"-shaped slot adopted in the planar dipole antenna in accordance with the second preferred embodiment of the present invention.

FIGS. 6 and 7 are graphs illustrating results of a performance test of the planar dipole ultra-wideband antenna with or without a "V"-shaped slot for achieving a frequency notch function. As can be seen from FIG. 6, when using the planar dipole antenna having a "V"-shaped slot, the VSWR value thereof rose over 20.

FIG. 7 is a graph illustrating variations of the voltage standing wave ratio (VSWR) depending on the length of one side of the "V"-shaped slot formed in the dipole antenna. As can be seen from FIG. 7, as the length (L) of one side of the V-shaped slot varies to 9.47 mm, 9.78 mm, and 9.99 mm, a frequency, which should not be interfered with, varies to 5.38 GHz, 5.25 GHz, and 4.96 GHz, respectively. Therefore, it is clearly understood that the ultra-wideband antenna in accordance with the present invention achieves a frequency notch function by utilizing a "V"-shaped slot, and enables variation of a notch frequency through the adjustment of the length of one side of the "V"-shaped slot.

As is apparent from the above description, the present invention provides an ultra-wideband antenna, which comprises a slot for achieving a frequency notch function, in addition to a radiating element included in existing ultra-wideband antennas. The slot has a form similar to that of the radiating element.

Further, according to the present invention, the ultra-wideband antenna can vary a notch frequency by adjusting the length and width of the slot for providing a frequency notch function.

Furthermore, the ultra-wideband antenna according to the present invention is a small planar antenna having the frequency notch function, thereby being capable of preventing interference with electromagnetic waves of existing communication systems, and achieving the compactness necessary of portable communication equipment.

Finally, the ultra-wideband antenna according to the present invention enables mass production thereof through the use of a printed circuit board method, thereby reducing the manufacturing costs of communication equipment.

Although preferred embodiments of the present invention have been disclosed above for illustrative purposes, those skilled in the art will appreciate that various modifications, additions, and substitutions are possible, without departing from the scope and spirit of the present invention as disclosed in the accompanying claims.

What is claimed is:

1. A planar antenna manufactured by patterning a substrate consisting of a dielectric layer, and first and second conductive layers applied, respectively, to both opposite surfaces of the dielectric layer, comprising:

a first slot formed in the first conductive layer for radiating electric waves;

a second slot formed in the first conductive layer for intercepting a particular frequency of the electric waves radiated by the first slot;

a power supply portion formed with the first conductive layer for supplying electric current to the first slot; and a radiating element formed with the second conductive layer, which is excited by the electric waves radiated by the first slot, and radiates the electric waves.

2. The antenna as set forth in claim 1, wherein the first slot has a bowtie shape.

3. The antenna as set forth in claim 2, wherein the power supply portion has one end connected to one side wall of the first slot.

4. The antenna as set forth in claim 1, wherein a size of the second slot is determined by a target interception frequency.

5. The antenna as set forth in claim 4, wherein the second slot has a "V"-shape.

6. The antenna as set forth in claim 5, wherein the radiating element is a miniature version of the first slot.

7. The antenna as set forth in claim 6, wherein the radiating element and the first slot have an area ratio of 1 to 5.6.

8. The antenna as set forth in claim 7, wherein a length and a width of the second slot are determined by the target interception frequency.

9. The antenna as set forth in claim 8, wherein a side of the second slot has a length that is half of a wavelength $\lambda_c$ of the target interception frequency.

10. The antenna as set forth in claim 9, wherein the width of the second slot is smaller than the value of $\lambda_c/25$.

11. The antenna as set forth in claim 1, wherein the radiating element has a bowtie shape.

12. A planar antenna comprising:

a dielectric substrate having a substantially square shape;

a first conductive layer attached at a first surface of the dielectric substrate, under the assumption that an axis penetrating through a center point of the dielectric substrate is a z-axis, and two axes extending parallel to the dielectric substrate so as to cross each other at a right angle are an x-axis and y-axis, respectively, the first conductive layer having a first slot in the form of an elongated bowtie extending along the x-axis with the z-axis as a center point thereof, a "V"-shaped second slot extending adjacent to the first slot, and a power supply portion connected to a side wall of the first slot; and a second conductive layer attached at a second surface of the dielectric substrate and including a bowtie shaped radiating element coaxial relative to the first slot.

13. The antenna as set forth in claim 12, wherein the first slot comprises a pair of isosceles triangle shaped cut portions, which are symmetrically arranged so that their apexes are approximate to face each other, each being defined by equilateral first and second inner walls, and a third inner wall as a base line.

14. The antenna as set forth in claim 13, wherein the second slot is cut along the symmetrical first inner walls of the two isosceles triangle shaped cut portions, in parallel thereto, thereby defining a "V"-shape.

15. The antenna as set forth in claim 14, wherein, at corners where the first and second inner walls of each isosceles triangle shaped cut portion meet with the third inner wall thereof, the first and second inner walls are bent to form an obtuse interior angle.

16. The antenna as set forth in claim 14, wherein the power supply portion is defined between both gaps extending from the apexes of the two isosceles triangle shaped cut portions to an edge of the dielectric substrate in an opposite direction of the second slot.

17. The antenna as set forth in claim 16, wherein the power supply portion is narrowed from the edge of the dielectric substrate toward the center point of the substrate.

18. The antenna as set forth in claim 17, wherein the power supply portion has a first end connected to a power source, and a second end connected to a position where the symmetrical second inner walls of the two isosceles triangle shaped cut portions are approximate to each other.

19. The antenna as set forth in claim 16, wherein each gap is narrowed from the edge of the dielectric substrate toward the center of the substrate.

20. The antenna as set forth in claim 16, wherein the power supply portion has a co-planar waveguide (CPW) structure.

21. The antenna as set forth in claim 12, wherein the radiating element and the first slot have an area ratio of 1 to 5.6.

22. The antenna as set forth in claim 12, wherein the radiating element is excited when electric current flows through the power supply portion.

23. The antenna as set forth in claim 12, wherein a length and a width of the second slot are determined by a target interception frequency.

24. The antenna as set forth in claim 23, wherein a first side of the second slot has a length that is half of a wavelength $\lambda_c$ of the target interception frequency.

25. The antenna as set forth in claim 24, wherein the width of the second slot is smaller than $\lambda_c/25$.

* * * * *